US009046805B1

(12) United States Patent
Tomari et al.

(10) Patent No.: US 9,046,805 B1
(45) Date of Patent: Jun. 2, 2015

(54) CHARGING MEMBER, IMAGE-FORMING APPARATUS, AND PROCESS CARTRIDGE

(71) Applicant: FUJI XEROX CO., LTD., Tokyo (JP)

(72) Inventors: Shogo Tomari, Kanagawa (JP); Hiroyuki Miura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/483,511

(22) Filed: Sep. 11, 2014

(30) Foreign Application Priority Data

Mar. 25, 2014 (JP) ..... 2014-062519

(51) Int. Cl.
*G03G 15/02* (2006.01)

(52) U.S. Cl.
CPC ..... *G03G 15/0233* (2013.01)

(58) Field of Classification Search
CPC ..... G03G 15/0233
See application file for complete search history.

(56) References Cited

U.S. PATENT DOCUMENTS

| | | | | |
|---|---|---|---|---|
| 2003/0083411 | A1* | 5/2003 | Sugiura et al. | 524/260 |
| 2009/0162092 | A1* | 6/2009 | Hoshio | 399/100 |
| 2011/0052262 | A1* | 3/2011 | Tomari et al. | 399/176 |
| 2011/0101572 | A1* | 5/2011 | Kim et al. | 264/470 |
| 2011/0281703 | A1* | 11/2011 | Tajima et al. | 492/18 |
| 2013/0288869 | A1* | 10/2013 | Tajima | 492/18 |
| 2014/0342892 | A1* | 11/2014 | Tajima | 492/18 |
| 2015/0018182 | A1* | 1/2015 | Feng et al. | 492/18 |

FOREIGN PATENT DOCUMENTS

JP A-2008-058609 3/2008

* cited by examiner

*Primary Examiner* — G. M. Hyder
(74) *Attorney, Agent, or Firm* — Oliff PLC

(57) ABSTRACT

A charging member includes a conductive support and a conductive elastic layer on the conductive support. The conductive elastic layer is made of a crosslinked product of a rubber composition containing a ternary epichlorohydrin rubber that is a copolymer of epichlorohydrin, an alkylene oxide, and allyl glycidyl ether; 4,4'-dithiodimorpholine; and a vulcanization accelerator that is a metal salt in an amount corresponding to 0.003 to 0.04 mol of metal per 100 g of the ternary epichlorohydrin rubber. The conductive elastic layer has a compression set of 20% or less.

8 Claims, 5 Drawing Sheets

CHARGING MEMBER, IMAGE-FORMING APPARATUS, AND PROCESS CARTRIDGE

CROSS-REFERENCE TO RELATED APPLICATIONS

This application is based on and claims priority under 35 USC 119 from Japanese Patent Application No. 2014-062519 filed Mar. 25, 2014.

BACKGROUND (i) Technical Field

The present invention relates to charging members, image-forming apparatuses, and process cartridges.

(ii) Related Art

In a typical electrophotographic image-forming apparatus, the surface of an image carrier such as an inorganic or organic photoconductive photoreceptor is charged by a charging device. An electrostatic latent image is then formed on the charged surface, for example, with a laser beam modulated with an image signal, and is developed with a charged toner to form a visible toner image. The toner image is electrostatically transferred to a recording medium such as recording paper directly or via an intermediate transfer member and is fixed to the recording medium to form a reproduced image.

Charging members are used in charging devices that charge the surface of an image carrier.

SUMMARY

According to an aspect of the invention, there is provided a charging member including a conductive support and a conductive elastic layer on the conductive support. The conductive elastic layer is made of a crosslinked product of a rubber composition containing a ternary epichlorohydrin rubber that is a copolymer of epichlorohydrin, an alkylene oxide, and allyl glycidyl ether; 4,4'dithiodimorpholine; and a vulcanization accelerator that is a metal salt in an amount corresponding to 0.003 to 0.04 mol of metal per 100 g of the ternary epichlorohydrin rubber. The conductive elastic layer has a compression set of 20% or less.

BRIEF DESCRIPTION OF THE DRAWINGS

Exemplary embodiments of the present invention will be described in detail based on the following figures, wherein.

DETAILED DESCRIPTION

Figure 1:
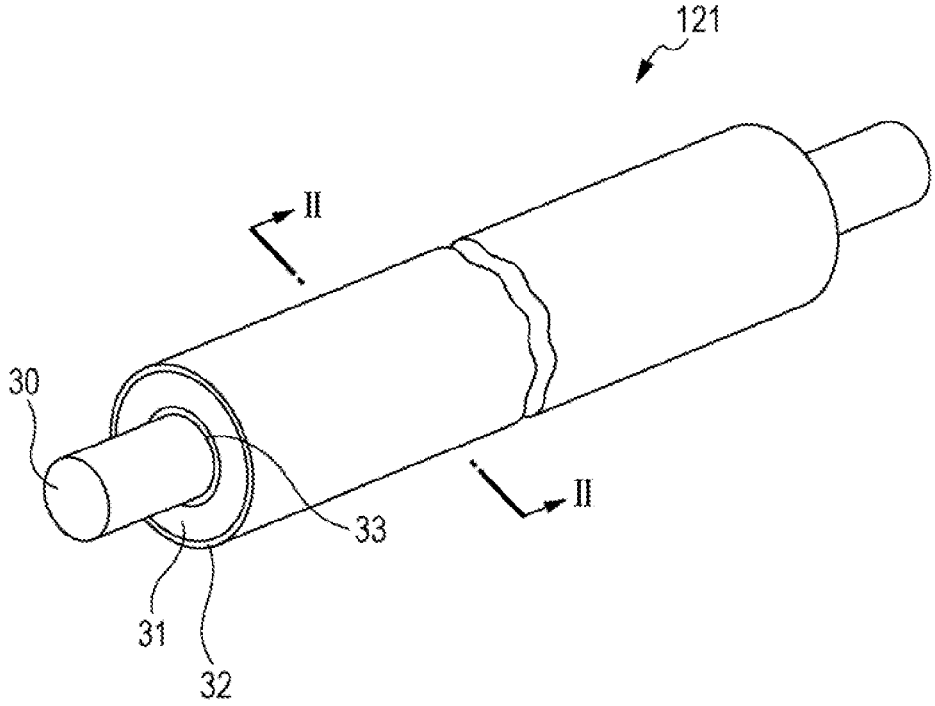
FIG. 1 is a schematic perspective view illustrating an example structure of a charging member according to an exemplary embodiment.

Exemplary embodiments of the present invention will now be described in detail.

Charging Member

A charging member according to an exemplary embodiment includes a conductive support and a conductive elastic layer (hereinafter also referred to as "rubber elastic layer" or simply "elastic layer") on the conductive support. The conductive elastic layer is made of a crosslinked product of a rubber composition containing a ternary epichlorohydrin rubber that is a copolymer of epichlorohydrin, an alkylene oxide, and allyl glycidyl ether; 4,4'-dithiodimorpholine; and a vulcanization accelerator that is a metal salt in an amount corresponding to 0.003 to 0.04 mol or about 0.003 to about 0.04 mol of metal per 100 g of the ternary epichlorohydrin rubber. The conductive elastic layer has a compression set of 20% or less or about 20% or less.

The charging member according to this exemplary embodiment may cause less variation in image density resulting from deformation due to contact with an electrophotographic photoreceptor in a nonoperating state. Although not fully understood, the mechanism is believed to be as follows.

A charging member for use in an image-forming apparatus including a contact charging system is used in contact with a photoreceptor. In a nonoperating state, deformation may remain in the contact portion of the charging member, which may affect the image quality. To reduce the influence of the deformation of the charging member on image quality, a charging member may be used that has sufficient rubber elasticity and superior compression set resistance.

A rubber roller for incorporation into an image-forming apparatus such as a copier, printer, or facsimile is typically manufactured by extrusion. For example, a rubber composition extruded into a cylinder is vulcanized and is then fitted onto a core. Alternatively, an unvulcanized rubber is applied to a core using an extruder equipped with a crosshead die and is then cured by vulcanization. Recently, crosshead extruders have been used to form rubber cylinders at low cost.

To manufacture a roller-shaped charging member (charging roller) by extrusion, a layer of a rubber composition is continuously vulcanized in a hot-air vulcanizing oven to form a rubber elastic layer. The rubber elastic layer, however, may be insufficiently vulcanized because of poor thermal efficiency. Such an elastic layer has low crosslink density and thus undergoes large deformation in a nonoperating state, for example, during storage or standby. This deformation may remain as compression set.

A typical vulcanization process is sulfur vulcanization, which proceeds through the reaction of a vulcanizing agent, which releases sulfur upon heating, a vulcanization accelerator, which promotes the release of sulfur, and zinc oxide, which serves as a vulcanization aid. The compression set may be reduced by increasing the crosslink density. The crosslink density may, in turn, be increased by increasing the amounts of vulcanizing agent and vulcanization accelerator. In this case, however, large amounts of unreacted components may remain because zinc oxide generally has low dispersibility and therefore has low reaction efficiency. Such a rubber composition may be recrosslinked in a deformed state and thus undergo further deformation during storage or standby.

In extrusion, an extruder is heated to promote the plasticization of an unvulcanized rubber. If the amounts of vulcanizing agent and vulcanization accelerator are increased, vulcanization may proceed inside the extruder and form irregularities on the surface of the resulting roller, which affect the image quality.

The use of multiple vulcanizing agents or vulcanization accelerators in combination may cause local variations in crosslink density due to the difference in crosslink length and vulcanization rate, depending on the dispersion condition. This may result in irregularities due to variations in scorching during extrusion.

The rubber composition for the conductive elastic layer of the charging member according to this exemplary embodiment contains a ternary epichlorohydrin rubber that is a copolymer of epichlorohydrin, an alkylene oxide, and allyl glycidyl ether, as an elastic material; 4,4'-dithiodimorpholine, as a vulcanizing agent; and a metal salt, as a vulcanization accelerator, in an amount corresponding to 0.003 to 0.04 mol or about 0.003 to about 0.04 mol of metal per 100 g of the ternary epichlorohydrin rubber. This rubber composition may be efficiently crosslinked and may achieve sufficient crosslink density after extrusion and vulcanization in a hot-air vulcanizing oven, thus providing improved compression set resistance. Thus, this rubber composition may form a conductive elastic layer having sufficient rubber elasticity and superior compression set resistance with a moderate molecular length as compared to that containing sulfur as a vulcanizing agent.

Although the charging member according to this exemplary embodiment may be composed only of the conductive support and the elastic layer, it may further include, for example, an intermediate layer (adhesive layer) disposed between the elastic layer and the conductive support, a surface layer disposed on the elastic layer, a resistance-controlling layer disposed between the elastic layer and the surface layer, and a protective layer disposed outside the surface layer (on the outermost side).

Figure 2:
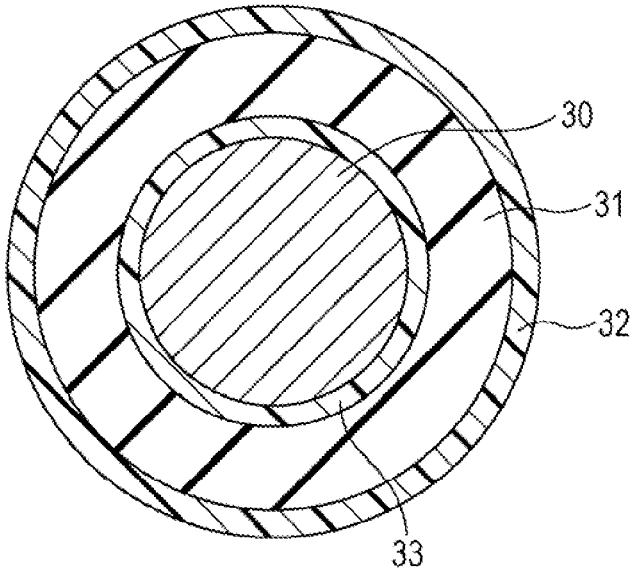
FIG. 2 is a schematic sectional view illustrating the example structure of the charging member according to the exemplary embodiment.

FIG. 1 is a schematic perspective view illustrating an example charging member according to this exemplary embodiment. FIG. 2 is a schematic sectional view of the charging member taken along line II-II in FIG. 1.

As shown in FIGS. 1 and 2, a charging member 121 according to this exemplary embodiment is a roller (charging roller) including, for example, a cylindrical conductive support (shaft) 30, an adhesive layer 33 disposed on the outer surface of the conductive support 30, an elastic layer 31 disposed on the outer surface of the adhesive layer 33, and a surface layer 32 disposed on the outer surface of the elastic layer 31.

The charging member 121 according to this exemplary embodiment may have other structures. For example, the charging member 121 may further include a resistance-controlling layer and a migration-preventing layer disposed between the elastic layer 31 and the surface layer 32 and a coating layer (protective layer) disposed outside the surface layer 32 (on the outermost side).

As used herein, the term "conductive" refers to a volume resistivity at 20° C. of less than $1\times10^{13}$ Ωcm.

The components of the charging member 121 according to this exemplary embodiment will now be described in detail.

Conductive Support

The conductive support 30 is a cylindrical member (shaft) that functions as an electrode and support for the charging member 121.

Examples of materials for the conductive support 30 include metals such as iron (e.g., free-cutting steel), copper, brass, stainless steel, aluminum, and nickel. The conductive support 30 may also be, for example, a member (e.g., a resin or ceramic member) having a plated outer surface or a member (e.g., a resin or ceramic member) having a conductor dispersed therein.

The conductive support 30 may be either a hollow member (tubular member) or a solid member.

Elastic Layer

The elastic layer 31 is disposed on the outer surface of the conductive support 30 with the adhesive layer 33 therebetween.

The elastic layer 31 is made of a crosslinked product of a rubber composition containing a ternary epichlorohydrin rubber that is a copolymer of epichlorohydrin, an alkylene oxide, and allyl glycidyl ether; 4,4'-dithiodimorpholine; and a vulcanization accelerator that is a metal salt in an amount corresponding to 0.003 to 0.04 mol or about 0.003 to about 0.04 mol of metal per 100 g of the ternary epichlorohydrin rubber. The elastic layer 31 has a compression set of 20% or less or about 20% or less.

The compression set of the elastic layer 31 according to this exemplary embodiment is measured by the following procedure.

A portion of the elastic layer 31 is removed from the charging member 121 and is vulcanized in an electric heat press using a die for forming a test piece in accordance with JIS K 6262 (1997) at 170° C. for 20 minutes to form a test piece. The test piece is set on a compression jig. The test piece is inserted in the center between compression plates, with specified spacers inserted outside the test piece. The test piece is compressed 25% in a hot-air dryer at 70° C. for 22 hours. After the test piece is left standing for 30 minutes, the recovery thereof is measured. The compression set of the elastic layer 31 is determined by the following equation:

$$CS = \frac{t_0 - t_2}{t_0 - t_1} \times 100$$

CS: compression set (%)

$t_0$: original thickness of test piece (mm)

$t_1$: thickness of spacers (mm)

$t_2$: thickness of test piece 30 minutes after removal from compression apparatus (mm)

Elastic Material

The rubber composition for the elastic layer 31 according to this exemplary embodiment contains, as an elastic material (rubber material), a terpolymer of epichlorohydrin, an alkylene oxide, and allyl glycidyl ether (ternary epichlorohydrin rubber).

The ternary epichlorohydrin rubber may have elasticity due to epichlorohydrin and conductivity due to the alkylene oxide and undergo a crosslinking reaction between allyl glycidyl ether and the vulcanizing agent (4,4'-dithiodimorpholine). This may contribute to the formation of a conductive elastic layer 31 having a compression set of 20% or less or about 20% or less.

The rubber composition according to this exemplary embodiment may further contain elastic materials other than ternary epichlorohydrin rubbers, provided that they do not interfere with the formation of a conductive elastic layer 31 having a compression set of 20% or less or about 20% or less. Examples of such elastic materials include isoprene rubber, chloroprene rubber (CR), epichlorohydrin rubber, butyl rubber, polyurethane, silicone rubber, fluorocarbon rubber, styrene-butadiene rubber (SBR), butadiene rubber, nitrile rubber, ethylene-propylene rubber, ethylene-propylene-diene monomer rubber (EPDM), acrylonitrile-butadiene copolymer rubber (NBR), natural rubber, and blends thereof. These rubbers may be foamed or unfoamed.

Vulcanizing Agent

The rubber composition according to this exemplary embodiment contains 4,4'-dithiodimorpholine as a vulcanizing agent.

An elastic layer is typically formed using sulfur as a vulcanizing agent. However, deformation tends to remain in the elastic layer because sulfur forms long molecular chains.

In contrast, 4,4'-dithiodimorpholine, which forms a disulfide bond, may increase the crosslink density of the elastic layer 31 without forming long molecular chains as compared to sulfur. This may contribute to the formation of a conductive elastic layer 31 having a compression set of 20% or less or about 20% or less.

Although 4,4'-dithiodimorpholine may be present in any amount sufficient to form an elastic layer 31 having a compression set of 20% or less or about 20% or less, it is preferably present in an amount of 0.5 to less than 20.0 parts by weight or about 0.5 to less than about 20.0 parts by weight, more preferably 0.5 to 15.0 parts by weight or about 0.5 to about 15.0 parts by weight, even more preferably 1.0 to 10.0 parts by weight or about 1.0 to about 10.0 parts by weight, per 100 parts by weight of the ternary epichlorohydrin rubber.

If 4,4'-dithiodimorpholine is present in an amount of 15.0 parts by weight or less, little or no unreacted vulcanizing agent may remain, which would otherwise react with unreacted double bonds and thus cause further compression set in a compressed state. If 4,4'-dithiodimorpholine is present in an amount of 0.5 part by weight or more, the rubber composition may be sufficiently crosslinked to form an elastic layer 31 having a compression set of 20% or less or about 20% or less.

The rubber composition according to this exemplary embodiment may further contain other vulcanizing agents such as sulfur, provided that they do not interfere with the formation of a conductive elastic layer 32 having a compression set of 20% or less or about 20% or less.

Vulcanization Accelerator

The rubber composition according to this exemplary embodiment contains a metal salt as a vulcanization accelerator in an amount corresponding to 0.003 to 0.04 mol or about 0.003 to about 0.04 mol of metal per 100 g of the ternary epichlorohydrin rubber.

If the metal salt used as a vulcanization accelerator is present in an amount corresponding to less than 0.003 mol of metal, the vulcanization reaction does not proceed sufficiently. If the metal salt is present in an amount corresponding to more than 0.04 mol of metal, the vulcanization reaction proceeds quickly and thus causes scorching during molding. This results in increased viscosity, which makes it difficult to mold the rubber composition.

Accordingly, the rubber composition for the elastic layer 31 according to this exemplary embodiment may contain a metal salt as a vulcanization accelerator in an amount corresponding to 0.006 to 0.02 mol or about 0.006 to about 0.02 mol of metal per 100 g of the ternary epichlorohydrin rubber.

The metal salt used as a vulcanization accelerator may be a dithiocarbamic acid salt. Examples of dithiocarbamic acid salts include zinc dimethyldithiocarbamate, zinc diethyldithiocarbamate, zinc dibutyldithiocarbamate, zinc N-ethyl-N-phenyldithiocarbamate, zinc N-pentamethylenedithiocarbamate, sodium dibutyldithiocarbamate, tellurium diethyldithiocarbamate, and zinc isopropylxanthate. In particular, zinc diethyldithiocarbamate may be used to achieve less variation in image density.

The rubber composition according to this exemplary embodiment may further contain vulcanization accelerators other than metal salts, provided that they do not interfere with the formation of a conductive elastic layer 31 having a compression set of 20% or less or about 20% or less.

The rubber composition for the elastic layer 31 according to this exemplary embodiment may optionally contain other additives, provided that they do not interfere with the formation of a conductive elastic layer 31 having a compression set of 20% or less or about 20% or less. Examples of other additives include conductors, fillers, softeners, and plasticizers.

Examples of conductors include electron conductors and ionic conductors.

Examples of electron conductors include powders of carbon blacks such as Ketjenblack and acetylene black; other carbonaceous materials such as pyrolytic carbon and graphite; various conductive metals and alloys such as aluminum, copper, nickel, and stainless steel; various conductive metal oxides such as tin oxide, indium oxide, titanium oxide, tin oxide-antimony oxide solid solution, and tin oxide-indium oxide solid solution; and insulators that are surface-treated to be conductive.

Examples of ionic conductors include perchlorates and chlorates of tetraethylammonium, lauryltrimethylammonium, and the like and perchlorates and chlorates of alkali metals such as lithium and alkaline earth metals such as magnesium.

These conductors may be used alone or in combination.

Examples of carbon blacks include Special Black 350, Special Black 4, Special Black 4A, Special Black 550, Special Black 6, Color Black FW200, Color Black FW2, and Color Black FW2V from Degussa AG; and Monarch 1000, Monarch 1300, Monarch 1400, Mogul L, and Regal 400R from Cabot Corporation.

The conductor may have an average particle size of 1 to 200 nm.

The average particle size of the conductor is determined as the average of the diameters (maximum diameters) of 100 conductor particles in a sample cut from the elastic layer 31 as measured under an electron microscope.

The conductor may be added in any amount. If an electron conductor is used, the conductor is preferably added in an amount of 1 to 30 parts by weight, more preferably 15 to 25 parts by weight, per 100 parts by weight of the elastic material. If an ionic conductor is used, the conductor is preferably added in an amount of 0.1 to 5.0 parts by weight, more preferably 0.5 to 3.0 parts by weight, per 100 parts by weight of the elastic material.

Examples of other additives include fillers such as calcium carbonate, talc, clay, and silica and softeners and plasticizers such as liquid NBR, paraffin oils, and polyesters.

The elastic layer 31 according to this exemplary embodiment may be formed, for example, by molding a rubber composition into a cylinder and then crosslinking the rubber composition by heating. The rubber composition contains a ternary epichlorohydrin rubber that is a copolymer of epichlorohydrin, an alkylene oxide, and allyl glycidyl ether; 4,4'-dithiodimorpholine; a vulcanization accelerator that is a metal salt in an amount corresponding to 0.003 to 0.04 mol or about 0.003 to about 0.04 mol of metal per 100 g of the ternary epichlorohydrin rubber; and optionally other additives. The resulting elastic layer 31 has a compression set of 20% or less or about 20% or less.

The elastic layer 31 may have a volume resistivity of $10^3$ to $10^{14}$ Ωcm.

Adhesive Layer

The adhesive layer 33 is made of a composition containing an adhesive (resin or rubber) and optionally additives such as conductors and crosslinking agents.

Resin or Rubber

Examples of resins for the adhesive layer 33 include polyurethanes, acrylic resins such as polymethyl methacrylate and polybutyl methacrylate, polyvinyl butyral, polyvinyl acetal, polyarylates, polycarbonates (PC), polyesters, phenoxy resins, polyvinyl acetate, polyamides, polyvinylpyridine, and cellulose resins. Examples of rubbers for the adhesive layer 33 include rubbers such as EPDM, polybutadiene, natural rubber, polyisoprene, SBR, CR, NBR, silicone rubber, urethane rubber, and epichlorohydrin rubber; and resin materials such as butadiene resins (RB), polystyrenes such as styrene-butadiene-styrene elastomer (SBS), polyolefins, polyesters, polyurethanes, polyethylene (PE), polypropylene (PP), polyvinyl chloride (PVC), acrylic resins, styrene-vinyl acetate copolymers, butadiene-acrylonitrile copolymers, ethylene-vinyl acetate copolymers, ethylene-ethyl acrylate copolymers, ethylene-methacrylic acid (EMAA) copolymers, and modified derivatives thereof.

Particularly, the examples include CR, epichlorohydrin rubber, chlorosulfonated polyethylene, and chlorinated polyethylene.

Conductor

The adhesive layer 33 may contain a conductor for imparting conductivity to the adhesive layer 33.

Examples of conductors include powders of carbon blacks such as Ketjenblack and acetylene black; other carbonaceous materials such as pyrolytic carbon and graphite; various conductive metals and alloys such as aluminum, copper, nickel, and stainless steel; various conductive metal oxides such as tin oxide, indium oxide, titanium oxide, tin oxide-antimony oxide solid solution, and tin oxide-indium oxide solid solution; and insulators that are surface-treated to be conductive.

The conductor preferably has an average particle size of 0.01 to 5 μm, more preferably 0.01 to 3 μm, even more preferably 0.01 to 2 μm.

The average particle size of the conductor is determined as the average of the diameters (maximum diameters) of 100 conductor particles in a sample cut from the adhesive layer 33 as measured under an electron microscope.

The conductor is preferably added to the adhesive layer 33 in an amount of 0.1 to 6 parts by weight, more preferably 0.5 to 6 parts by weight, even more preferably 1 to 3 parts by weight, per 100 parts by weight of the total weight of the adhesive layer 33.

Crosslinking Agent

The adhesive layer 33 may contain a crosslinking agent. For example, the adhesive layer 33 may contain a crosslinking agent having two or more functional groups that react with halogens (halogen-crosslinking agent).

Examples of halogen-crosslinking agents include polyamine crosslinking agents, thiourea crosslinking agents, thiadiazole crosslinking agents, triazine crosslinking agents, pyrazine crosslinking agents, quinoxaline crosslinking agents, and bisphenol crosslinking agents.

Examples of polyamine crosslinking agents include ethylenediamine, hexamethylenediamine, diethylenetriamine, triethylenetetramine, hexamethylenetetramine, p-phenylenediamine, cumenediamine, N,N'-dicinnamylidene-1,6-hexanediamine, ethylenediamine carbamate, and hexamethylenediamine carbamate.

Examples of thiourea crosslinking agents include ethylenethiourea, 1,3-diethylthiourea, 1,3-dibutylthiourea, and trimethylthiourea.

Examples of thiadiazole crosslinking agents include 2,5-dimercapto-1,3,4-thiadiazole and 2-mercapto-1,3,4-thiadiazole-5-thiobenzoate.

Examples of triazine crosslinking agents include 2,4,6-trimercapto-1,3,5-triazine, 2-methoxy-4,6-dimercaptotriazine, 2-hexylamino-4,6-dimercaptotriazine, 2-diethylamino-4,6-dimercaptotriazine, 2-cyclohexaneamino-4,6-dimercaptotriazine, 2-dibutylamino-4,6-dimercaptotriazine, 2-anilino-4,6-dimercaptotriazine, and 2-phenylamino-4,6-dimercaptotriazine.

Examples of pyrazine crosslinking agents include 2,3-dimercaptopyrazines such as pyrazine-2,3-dithiocarbonate, 5-methyl-2,3-dimercaptopyrazine, 5-ethylpyrazine-2,3-dithiocarbonate, 5,6-dimethyl-2,3-dimercaptopyrazine, and 5,6-dimethylpyrazine-2,3-dithiocarbonate.

Examples of quinoxaline crosslinking agents include 2,3-dimercaptoquinoxalines such as quinoxaline-2,3-dithiocarbonate, 6-methylquinoxaline-2,3-dithiocarbonate, 6-ethyl-2,3-dimercaptoquinoxaline, 6-isopropylquinoxaline-2,3-dithiocarbonate, and 5,8-dimethylquinoxaline-2,3-dithiocarbonate.

Examples of bisphenol crosslinking agents include 4,4'-dihydroxydiphenylsulfoxide, 4,4'-dihydroxydiphenylsulfone (bisphenol S), 1,1-cyclohexylidene-bis(4-hydroxybenzene), 2-chloro-1,4-cyclohexylene-bis(4-hydroxybenzene), 2,2-isopropylidene-bis(4-hydroxybenzene) (bisphenol A), hexafluoroisopropylidene-bis(4-hydroxybenzene) (bisphenol AF), and 2-fluoro-1,4-phenylene-bis(4-hydroxybenzene).

Particularly, the examples include triazines, quinoxalines, and thioureas.

These halogen-crosslinking agents may be used alone or in combination.

The halogen-crosslinking agent may be added to the material for the adhesive layer 33 in an amount of 0.005 to 15 parts by weight, more preferably 0.01 to 10 parts by weight, even more preferably 0.05 to 10 parts by weight, per 100 parts by weight of the halogen-containing resin.

Other Components

In addition to the crosslinking agent, adhesive, and conductor described above, the adhesive layer 33 may contain other components such as catalysts, curing promoters, inorganic fillers, organic or polymer fillers, flame retardants, antistatic agents, conductivity-imparting agents, lubricants, slidability-imparting agents, surfactants, colorants, and acid acceptors. The adhesive layer 33 may contain two or more of the above components.

Examples of acid acceptors include metal compounds and hydrotalcites. Examples of metal compounds serving as acid acceptors include oxides, hydroxides, carbonates, carboxylates, silicates, borates, and phosphites of Group 2 elements of the periodic table (alkaline earth metals); and oxides, basic carbonates, basic carboxylates, basic phosphites, and tribasic sulfates of Group 4 elements of the periodic table. Specific examples of such compounds include magnesium oxide, magnesium hydroxide, barium hydroxide, magnesium carbonate, barium carbonate, calcium oxide, calcium hydroxide, calcium carbonate, calcium silicate, calcium stearate, zinc stearate, calcium phthalate, calcium phosphite, zinc oxide, tin oxide, tin stearate, and basic tin phosphite.

If the adhesive layer 33 contains an acid acceptor, it may inhibit the corrosion of the conductive support 30 with an acidic component generated from the elastic layer 31, thus further improving the adhesion.

Examples of curing promoters include 1,8-diazabicyclo(5.4.0)undecene-7 (hereinafter abbreviated as DBU) salts and 1,5-diazabicyclo(4.3.0)nonene-5 (hereinafter abbreviated as DBN) salts. Examples of DBU salts include DBU-carbonate, DBU-stearate, DBU-2-ethylhexanoate, DBU-benzoate, DBU-salicylate, DBU-3-hydroxy-2-naphthoate, DBU-phenol salt, DBU-2-mercaptobenzothiazole, and DBU-2-mercaptobenzimidazole. Examples of DBN salts include DBN-carbonate, DBN-stearate, DBN-2-ethythexanoate, DBN-benzoate, DBN-salicylate, DBN-3-hydroxy-2-naphthoate, DBN-phenol salt, DBN-2-mercaptobenzothiazole, and DBN-2-mercaptobenzimidazole.

Surface Layer

The charging member 121 according to this exemplary embodiment may include the surface layer 32 disposed on the elastic layer 31.

The surface layer 32 contains, for example, a resin and optionally additives such as conductors and particles for imparting roughness (particular surface roughness) to the surface of the surface layer 32.

Examples of resins (polymeric materials) for the surface layer 32 include, but not limited to, polyamides, polyurethanes, polyvinylidene fluoride (PVDF), ethylene tetrafluoride copolymers, polyesters, polyimides, silicone resins, acrylic resins, polyvinyl butyral, ethylene-tetrafluoroethylene copolymers (ETFE), melamine resins, fluorocarbon rubber, epoxy resins, PC, polyvinyl alcohol, cellulose, polyvinylidene chloride, PVC, PE, and ethylene-vinyl acetate copolymers.

The above polymeric materials may be used alone or as a mixture or copolymer thereof. These resins preferably have a number average molecular weight of 1,000 to 100,000, more preferably 10,000 to 50,000.

The surface layer 32 may be formed from a mixture of the resin with additives such as conductors that may be used in the elastic layer 31 and various particles as illustrated below. These additives may be added in any amount, preferably 1 to 50 parts by weight, more, preferably 5 to 20 parts by weight, per 100 parts by weight of the resin.

Examples of particles include, but not limited to, particles of metal oxides and multiple metal oxides such as silicon oxide, aluminum oxide, and barium titanate and polymers such as polytetrafluoroethylene and polyvinylidene fluoride, which may be used alone or as a mixture thereof.

A thicker surface layer 32 may be formed to provide a charging member 121 having a higher wear resistance. Specifically, the surface layer 32 preferably has a thickness of 0.01 to 1,000 μm, more preferably 0.1 to 500 μm, even more preferably 0.5 to 100 μm.

The surface layer 32 may be formed as follows. A dispersion for the surface layer 32 is prepared from a solvent, a resin, and optionally additives such as conductors and particles for imparting roughness (particular surface roughness) to the surface of the surface layer 32. The dispersion is then applied to the elastic layer 31 by a process such as dipping, spraying, vacuum evaporation, or plasma coating. To facilitate the manufacturing process, dipping may be used.

Method for Manufacturing Charging Member

A method for manufacturing a charging member according to an exemplary embodiment includes a rubber-composition-layer forming step of applying a rubber composition to a conductive support to form a rubber composition layer and a conductive-elastic-layer forming step of heating the rubber composition layer to effect a crosslinking reaction, thereby forming a conductive elastic layer having a compression set of 20% or less or about 20% or less. The rubber composition contains a ternary epichlorohydrin rubber that is a copolymer of epichlorohydrin, an alkylene oxide, and allyl glycidyl ether; 4,4'-dithiodimorpholine; and a vulcanization accelerator that is a metal salt in an amount corresponding to 0.003 to 0.04 mol or about 0.003 to about 0.04 mol of metal per 100 g of the ternary epichlorohydrin rubber.

The method for manufacturing the charging member according to this exemplary embodiment may optionally include a step of forming an adhesive layer on the conductive support before the rubber-composition-layer forming step and a step of forming a surface layer after the conductive-elastic-layer forming step.

Rubber-Composition-Layer Forming Step

The rubber composition layer is formed on the outer surface of the adhesive layer 33 by extruding the rubber composition together with the conductive support 30 having the adhesive layer 33 formed thereon, for example, using an extruder equipped with a crosshead die.

A method for forming the rubber composition layer using an extruder equipped with a crosshead die will now be described with reference to the drawings.

Figure 3:
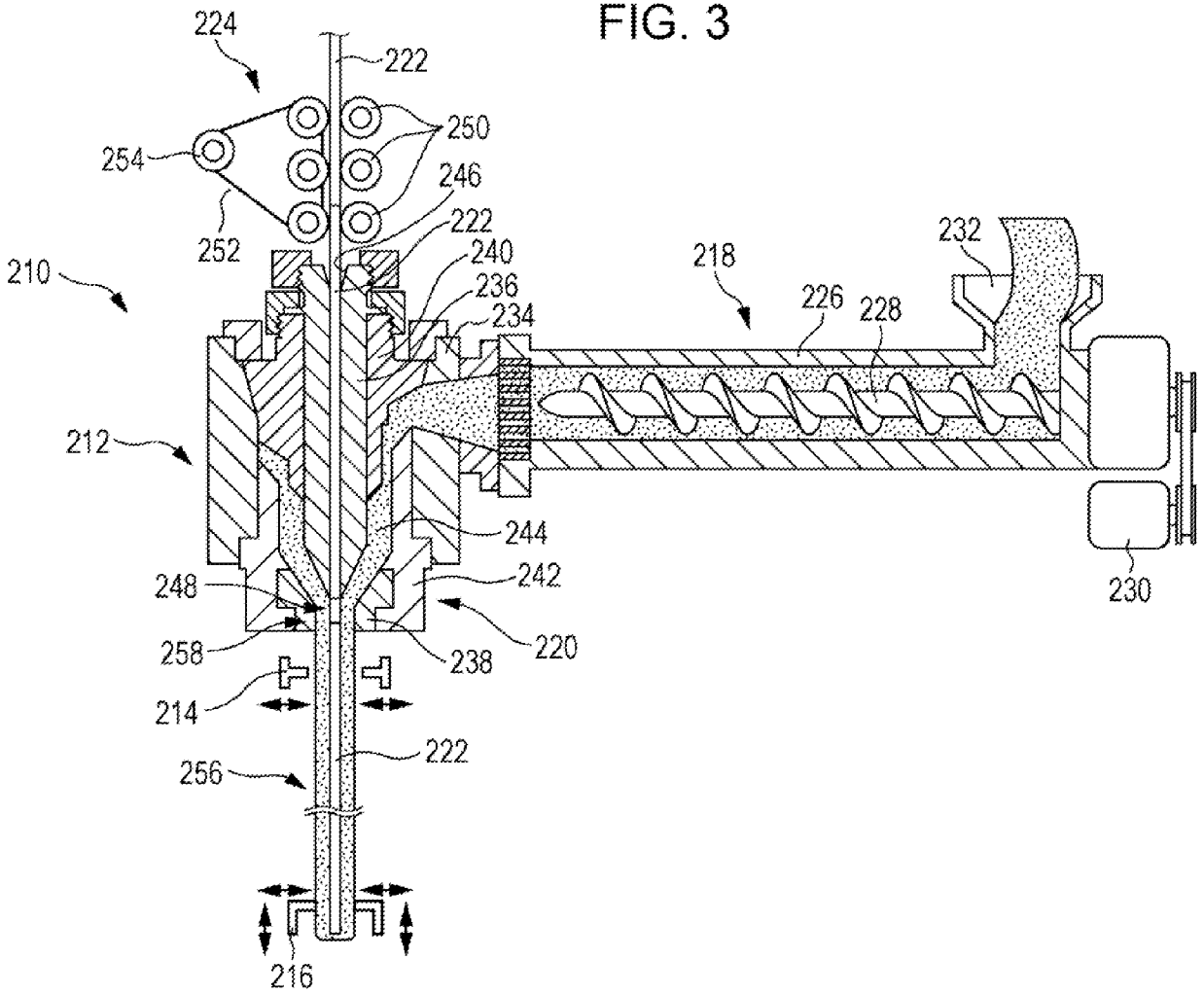
FIG. 3 is a schematic view illustrating an example structure of an extruder equipped with a crosshead die.

FIG. 3 schematically illustrates the structure of a rubber-roller manufacturing apparatus (extruder equipped with a crosshead die) 210 used to form an elastic layer in this exemplary embodiment.

The rubber-roller manufacturing apparatus 210 according to this exemplary embodiment includes a discharge device 212 including a crosshead die, a pressing device 214 disposed below the discharge device 212, and a drawing device 216 disposed below the pressing device 214.

The discharge device 212 includes a rubber-feeding unit 218 that feeds an unvulcanized rubber (the rubber composition for the elastic layer 31), an extruding unit 220 that extrudes the rubber fed by the rubber-feeding unit 218 into a cylinder, and a core-feeding unit 224 that feeds a core 222 (the conductive support 30 having the adhesive layer 33 formed thereon) to the center of the rubber extruded into a cylinder by the extruding unit 220.

The rubber-feeding unit 218 includes a cylinder 226 and a screw 228 disposed therein. The screw 228 is rotated by a drive motor 230. A hopper 232 into which the rubber (rubber composition) is charged is disposed on the cylinder 226 adjacent to the drive motor 230. The rubber charged into the hopper 232 is fed to the extruding unit 220 while being kneaded by the screw 228 inside the cylinder 226. The feed rate of the rubber is controlled depending on the rotational speed of the screw 228.

The extruding unit 220 includes a cylindrical case 234 connected to the rubber-feeding unit 218, a cylindrical mandrel 236 disposed in the center of the case 234, and a discharge head 238 disposed below the mandrel 236. The mandrel 236 is secured to the case 234 with a securing member 240. The discharge head 238 is secured to the case 234 with a securing member 242. An annular channel 244 through which the rubber flows annularly is defined between the outer surface of the mandrel 236 (and the outer surface of the securing member 240 in part) and the inner surface of the securing member 242 (and the inner surface of the discharge head 238 in part).

The mandrel 236 has an insertion hole 246 through which the core 222 is inserted in the center thereof. The bottom of the mandrel 236 is tapered toward the leading end thereof. Located below the leading end of the mandrel 236 is a junction 248 where the core 222 fed from the insertion hole 246 meets the rubber fed from the annular channel 244. While the rubber is extruded into a cylinder toward the junction 248, the core 222 is fed to the center of the rubber extruded into a cylinder.

The core-feeding unit 224 includes multiple (three) pairs of rollers 250 disposed above the mandrel 236. One roller 250 of each pair is linked to a drive roller 254 via a belt 252. As the drive roller 254 is driven, a core 222 held between the pairs of rollers 250 is fed to the insertion hole 246 of the mandrel 236.

A series of cores 222 having a predetermined length sequentially pass through the insertion hole 246 such that a preceding core 222 present in the insertion hole 246 of the mandrel 236 is pushed by a following core 222 fed by the pairs of rollers 250. The drive roller 254 is temporarily stopped when the front end of the preceding core 222 reaches the leading end of the mandrel 236, and the core 222 is fed to the junction 248 below the mandrel 236 at a time interval.

In this manner, the discharge device 212 extrudes the rubber into a cylinder at the junction 248 while sequentially feeding each core 222 (the conductive support 30 having the adhesive layer 33 formed thereon) to the center of the rubber at a time interval. Thus, the outer surface of the core 222 is coated with the rubber to form an unvulcanized rubber roller including a rubber roller part 256 (rubber composition layer) formed on the outer surface of the core 222.

The rubber composition layer preferably has a thickness of 1 to 10 mm, more preferably 2 to 5 mm.

Elastic-Layer Forming Step

The rubber composition layer is then heated to effect a crosslinking reaction.

The unvulcanized rubber roller is vulcanized, for example, in an air vulcanizing oven (hot-air heating oven) at 140° C. to 180° C. for 20 to 300 minutes. Thus, a vulcanized rubber roller is formed that includes a conductive elastic layer having a compression set of 20% or less or about 20% or less on the adhesive layer.

Charging Device

A charging device according to an exemplary embodiment will now be described.

Figure 4:
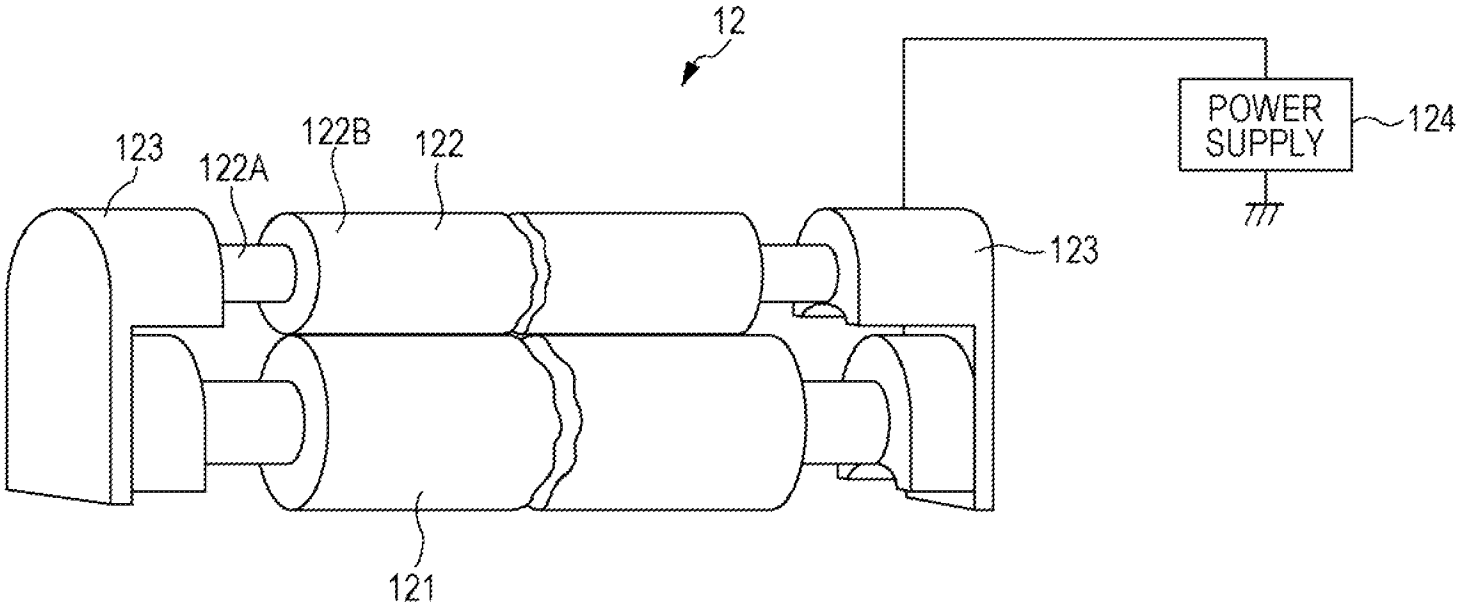
FIG. 4 is a schematic view illustrating an example structure of a charging device according to an exemplary embodiment.

FIG. 4 is a schematic view illustrating an example charging device according to an exemplary embodiment.

The charging device according to this exemplary embodiment includes the charging member according to the exemplary embodiment described above.

As shown in FIG. 4, a charging device 12 according to this exemplary embodiment includes, for example, the charging member 121 and a cleaning member 122, which are disposed in contact at a particular depth of penetration. The conductive support 30 of the charging member 121 and a conductive support 122A of the cleaning member 122 are held at both ends in the axial direction by conductive bearings (e.g., conductive rolling bearings) 123 so as to be rotatable. A power supply 124 is connected to one of the conductive bearings 123.

The charging device 12 according to this exemplary embodiment may have other structures. For example, the cleaning member 122 may be omitted.

The cleaning member 122, such as a roller, cleans the surface of the charging member 121. The cleaning member 122 includes, for example, a cylindrical conductive support 122A and an elastic layer 122B disposed on the outer surface of the conductive support 122A.

The conductive support 122A is a conductive rod-shaped member. Examples of materials for the conductive support 122A include metals such as iron (e.g., free-cutting steel), copper, brass, stainless steel, aluminum, and nickel. The conductive support 122A may also be, for example, a member (e.g., a resin or ceramic member) having a plated outer surface or a member (e.g., a resin or ceramic member) having a conductor dispersed therein. The conductive support 122A may be either a hollow member (tubular member) or a solid member.

The elastic layer 122B may be made of a foam having a three-dimensional porous structure and may have cavities in the interior thereof and irregularities in the surface thereof (hereinafter referred to as "cells"). Examples of materials for the elastic layer 122B include foamable resin materials such as polyurethanes, polyolefins such as PE and PP, polyamides, and melamine resins; and foamable rubber materials such as NBR, EPDM, natural rubber, SBR, CR, silicone rubber, and nitrile rubber.

Among these foamable resin materials and rubber materials, polyurethanes, which have high tear resistance and tensile strength, may be used. This may allow the cleaning member 122 to efficiently remove foreign matter, such as toner and external additive, from the charging member 121 by rubbing, to form fewer scratches on the surface of the charging member 121 during rubbing, and to resist tearing and damage for a long period of time.

Examples of polyurethanes include, but not limited to, reaction products of polyols (such as polyester polyols, polyether polyols, and acrylic polyols) and isocyanates (such as 2,4-tolylene diisocyanate, 2,6-tolylene diisocyanate, 4,4-diphenylmethane diisocyanate, tolidine diisocyanate, and 1,6-hexamethylene diisocyanate) and reaction products thereof with chain extenders (such as 1,4-butanediol and trimethylolpropane). Typically, polyurethanes are foamed using blowing agents (such as water and azo compounds (e.g., azodicarbonamide and azobisisobutyronitrile).

The elastic layer 122B preferably has 20 to 80 cells/25 mm, more preferably 30 to 80 cells/25 mm, even more preferably 30 to 50 cells/25 mm.

The elastic layer 122B preferably has a hardness of 100 to 500 N, more preferably 100 to 400 N, even more preferably 150 to 400 N.

The conductive bearings 123 hold together the charging member 121 and the cleaning member 122 so as to be rotatable and also maintain the distance therebetween. The conductive bearings 123 may be of any type and may be made of any conductive material. For example, the conductive bearings 123 may be conductive rolling bearings or conductive plain bearings.

The power supply 124 applies a voltage to the conductive bearings 123 to charge the charging member 121 and the cleaning member 122 to the same polarity. The power supply 124 may be a known high-voltage power supply unit.

In the charging device 12 according to this exemplary embodiment, for example, the power supply 124 applies a voltage to the conductive bearings 123 to charge the charging member 121 and the cleaning member 122 to the same polarity.

Image-Forming Apparatus

An image-forming apparatus according to an exemplary embodiment will now be described.

The image-forming apparatus according to this exemplary embodiment includes an electrophotographic photoreceptor; a charging unit including the charging member according to the exemplary embodiment described above, which is disposed in contact with a surface of the electrophotographic photoreceptor to charge the electrophotographic photoreceptor; an electrostatic-latent-image forming unit that forms an electrostatic latent image on the surface of the charged electrophotographic photoreceptor; a developing unit that develops the electrostatic latent image formed on the surface of the electrophotographic photoreceptor with a developer containing a toner to form a toner image; and a transfer unit that transfers the toner image to a surface of a recording medium.

Figure 5:
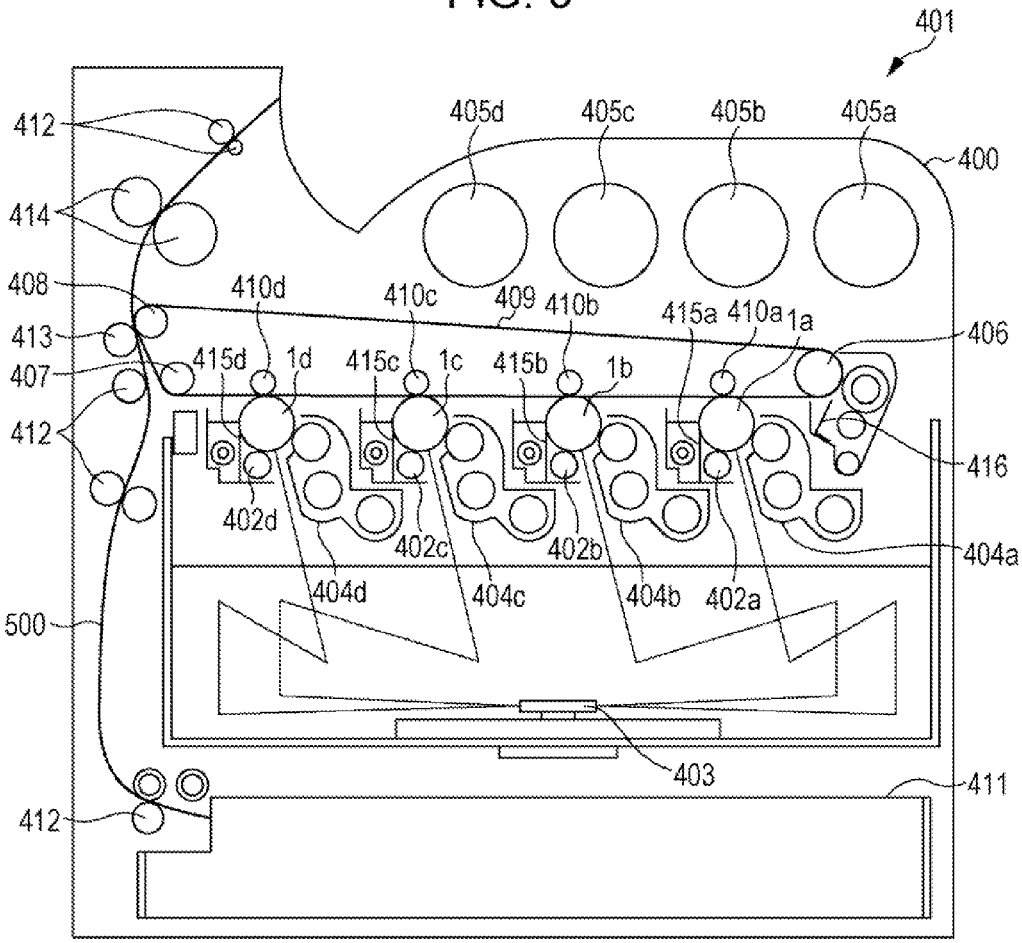
FIG. 5 is a schematic view illustrating an example structure of an image-forming apparatus according to an exemplary embodiment.

FIG. 5 schematically illustrates an example basic structure of the image-forming apparatus according to this exemplary embodiment. An image-forming apparatus 401 shown in FIG. 5 is an intermediate-transfer image-forming apparatus including a housing 400 in which four electrophotographic photoreceptors 1*a*, 1*b*, 1*c*, and 1*d* are arranged in parallel with each other along an intermediate transfer belt 409. For example, the photoreceptor 1*a* forms a yellow image, the photoreceptor 1*b* forms a magenta image, the photoreceptor 1*c* forms a cyan image, and the photoreceptor 1*d* forms a black image.

The electrophotographic photoreceptors 1*a*, 1*b*, 1*c*, and 1*d* mounted in the image-forming apparatus 401 are electrophotographic photoreceptors according to this exemplary embodiment.

The electrophotographic photoreceptors 1*a*, 1*b*, 1*c*, and 1*d* rotate in one direction (counterclockwise in FIG. 5). Located around the electrophotographic photoreceptors 1*a*, 1*b*, 1*c*, and 1*d* are, in order in the rotational direction, charging rollers 402*a*, 402*b*, 402*c*, and 402*d*, developing devices 404*a*, 404*b*, 404*c*, and 404*d*, first transfer rollers 410*a*, 410*b*, 410*c*, and 410*d*, and cleaning blades 415*a*, 415*b*, 415*c*, and 415*d*, respectively. The charging roller 402*a*, 402*b*, 402*c*, and 402*d* are contact charging rollers according to the exemplary embodiment described above.

The developing devices 404*a*, 404*b*, 404*c*, and 404*d* supply yellow, magenta, cyan, and black toners contained in toner cartridges 405*a*, 405*b*, 405*c*, and 405*d*, respectively. The first transfer rollers 410*a*, 410*b*, 410*c*, and 410*d* are disposed in contact with the electrophotographic photoreceptors 1*a*, 1*b*, 1*c*, and 1*d*, respectively, with the intermediate transfer belt 409 therebetween.

The housing 400 also accommodates a laser light source (exposure device) 403. After charging, the surfaces of the electrophotographic photoreceptors 1*a*, 1*b*, 1*c*, and 1*d* are irradiated with laser light emitted from the laser light source 403.

In this way, charging, exposure, developing, first transfer, and cleaning (removing foreign matter such as toner) steps are sequentially performed during the rotation of the electrophotographic photoreceptors 1*a*, 1*b*, 1*c*, and 1*d* to transfer toner images of different colors to the intermediate transfer belt 409 such that they are superimposed on top of each other. After the toner images are transferred to the intermediate transfer belt 409, the electrophotographic photoreceptors 1*a*, 1*b*, 1*c*, and 1*d* are subjected to the next image-forming process without a step of eliminating surface charge.

The intermediate transfer belt 409 is supported under tension by a drive roller 406, a back roller 408, and a support roller 407 and is rotated without sagging as these rollers 406, 407, and 408 rotate. A second transfer roller 413 is disposed in contact with the back roller 408 with the intermediate transfer belt 409 therebetween. After passing through the nip between the back roller 408 and the second transfer roller 413, the intermediate transfer belt 409 is cleaned, for example, by a cleaning blade 416 disposed opposite the drive roller 406, before the next image-forming process.

The housing 400 also accommodates a container 411 containing recording media. A recording medium 500, such as paper, is transported from the container 411 to the nip between the intermediate transfer belt 409 and the second transfer roller 413 by transport rollers 412, is transported to the nip between two fixing rollers 414 disposed in contact with each other, and is discharged outside the housing 400.

Although the above description illustrates the intermediate transfer member as the intermediate transfer belt 409, the intermediate transfer member may be either a belt, such as the intermediate transfer belt 409, or a drum. If the intermediate transfer member is a belt, it may include a substrate made of a known resin material. Examples of such resin materials include polyimides, PC, PVDF, polyalkylene terephthalates (PAT), blends such as ETFE/PC, ETFE/PAT, and PC/PAT, polyesters, polyetheretherketones, polyamides, and resin materials based thereon. These resin materials may be blended with elastic materials.

In this exemplary embodiment, any recording medium to which a toner image is transferred from an electrophotographic photoreceptor may be used.

Process Cartridge

A process cartridge according to an exemplary embodiment is attachable to and detachable from an image-forming apparatus and includes a charging unit including the charging member according to the exemplary embodiment described above. The charging member is disposed in contact with a surface of an electrophotographic photoreceptor to charge the electrophotographic photoreceptor.

Figure 6:
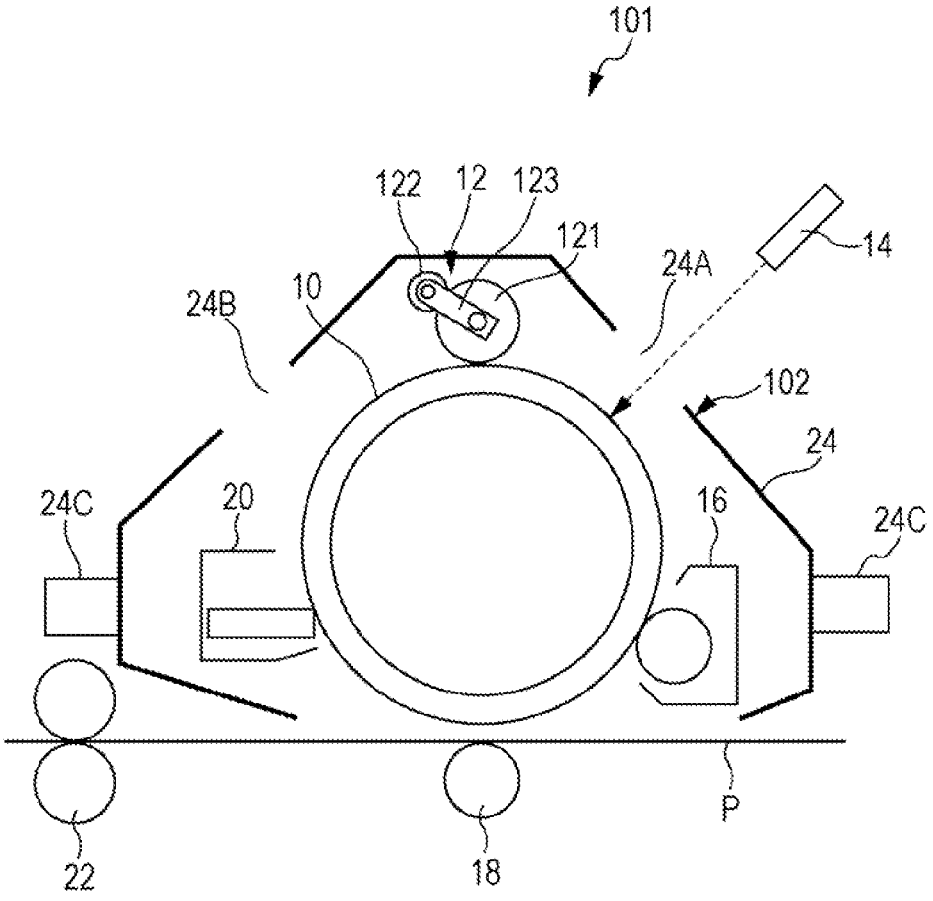
FIG. 6 is a schematic view illustrating an example structure of a process cartridge according to an exemplary embodiment.

FIG. 6 schematically illustrates an example basic structure of the process cartridge according to this exemplary embodiment. As shown in FIG. 6, a process cartridge 102 according to this exemplary embodiment includes an electrophotographic photoreceptor 10, a charging device 12 including the charging member 121 according to the exemplary embodiment described above, which is disposed in contact with the surface of the electrophotographic photoreceptor 10 to charge the electrophotographic photoreceptor 10, a developing device 16 that develops a latent image formed by an exposure device 14 with a toner to form a toner image, and a cleaning device 20 that removes residual toner from the surface of the electrophotographic photoreceptor 10 after transfer. The electrophotographic photoreceptor 10, the charging device 12, the developing device 16, and the cleaning device 20 are integrally supported by a casing 24 having an opening 24A for exposure, an opening 24B for erase exposure, and mounting rails 24C. The process cartridge 102 is detachably attached to an image-forming apparatus 101. The image-forming apparatus 101 according to this exemplary embodiment includes a fixing device 22 that fixes a toner image transferred to a recording medium P by a transfer device 18.

EXAMPLES

The present invention is further illustrated by the following examples, although the invention is not limited to these examples. In the examples, parts are by weight unless otherwise specified.

Example 1

Fabrication of Charging Member

Preparation of Rubber Composition

To fabricate a charging roller, a mixture having the following composition is kneaded with a tangential pressure kneader (from Moriyama Company Ltd., actual capacity: 55 L) and is passed through a strainer to prepare a rubber composition.

Specifically, while the jacket, pressure lid, and rotors of the pressure kneader are maintained at 20° C. with circulating water, the following rubber material is masticated while a pressure of 0.6 MPa is applied by the pressure lid. The masticated rubber material is compounded with zinc oxide, is compounded with stearic acid and carbon black, and is compounded with an ionic conductor and calcium carbonate. The rubber compound is cut into a sheet using a twin-screw sheet-preforming machine (from Moriyama Company Ltd., actual capacity: 75 L). After cooling to room temperature, the rubber compound is further compounded with a crosslinking agent and a vulcanization accelerator using the pressure kneader and is passed through a strainer using a gear pump extruder to prepare a rubber composition.

Composition of Rubber Composition

Rubber material 100 parts by weight (epichlorohydrin-ethylene oxide-allyl glycidyl ether copolymer rubber, the trade name "CG102", Daiso Co., Ltd.)

Zinc oxide 5 parts by weight (the trade name "Zinc Oxide II", Seido Chemical Industry Co., Ltd.)

Stearic acid 1 part by weight (the trade name "Stearic Acid S", Kao Corporation)

Carbon black 15 parts by weight (the trade name "Ketjenblack EC", Lion Corporation)

Calcium carbonate 20 parts by weight (the trade name "Hakuenka CCR", Shiraishi Kogyo Kaisha, Ltd.)

Ionic conductor 1 part by weight (benzyltrimethylammonium chloride, the trade name "BTMAC", Lion Akzo Co., Ltd.)

Vulcanizing agent 1 part by weight (the trade name "Vulnoc R", 4,4'-dithiodimorpholine, Ouchi Shinko Chemical Industrial Co., Ltd.)

Vulcanization accelerator 5 parts by weight (number of moles of metal element: 0.014 mol)

(the trade name "Nocceler EZ", zinc diethyldithiocarbamate, Ouchi Shinko Chemical Industrial Co., Ltd.)

Formation of Adhesive Layer

A mixture having the following composition is processed in a bead mill to prepare a dispersion. The dispersion is applied to a stainless steel (SUS303) conductive support (shaft) having a diameter of 8 mm and a length of 330 mm by dip coating and is then dried at 150° C. for 10 minutes to remove the solvent, thereby forming an adhesive layer.

Composition of Adhesive Layer

Resin material 100 parts by weight (chlorosulfonated polyethylene, the trade name "CN1500", Tosoh Corporation)

Conductor 40 parts by weight (carbon black, the trade name "Ketjenblack EC600JD", Lion Corporation)

Solvent 640 parts by weight (xylene, Kanto Chemical Co., Inc.)

Acid acceptor 5.0 parts by weight (magnesium oxide, the trade name "Kyowamag 150", Kyowa Chemical Industry Co., Ltd.)

Halogen-crosslinking agent 1.5 parts by weight (6-methylquinoxaline-2,3-dithiocarbonate, the trade name "XL21S", Daiso Co., Ltd.)

Curing promoter 1.0 part by weight (1,8-diazabicyclo(5.4.0)undecene-7, the trade name "DBU", San-Apro Ltd.)

Formation of Rubber Elastic Layer

The rubber composition is extruded through a single-screw rubber extruder including a cylinder having an inner diameter of 60 mm and a ratio of screw length (L (mm)) to screw diameter (D (mm)) (L/D) of 20 at a screw speed of 25 rpm while the conductive support having the adhesive layer formed thereon is continuously passed through a crosshead die. Thus, the rubber composition is applied to the conductive support to form an unvulcanized rubber roller. The cylinder, screw, head, and die of the extruder are all maintained at 80° C.

The unvulcanized rubber roller, including the conductive support and the rubber composition layer, is vulcanized in an air heating oven at 170° C. for 70 minutes to form a vulcanized rubber roller.

Formation of Surface Layer

A mixture having the following composition is processed in a bead mill to prepare a dispersion. The resulting dispersion is diluted with methanol to prepare a coating solution for a surface layer. The coating solution is adjusted to a viscosity of 45 mPa·s with methanol and butanol and is then poured into a dip coating bath.

Thereafter, the member having thereon the adhesive layer and the rubber elastic layer (vulcanized rubber roller) is dipped in and lifted out of the coating solution in the dip coating bath. The changing member 1 (rubber roller) is dried at 150° C. for 10 minutes to remove the solvent, thereby forming a surface layer. Thus, a charging roller is formed that includes the conductive support on which are disposed, in order, the adhesive layer (thickness: 0.015 mm), the rubber elastic layer (thickness: 2.0 mm), and the surface layer (thickness: 0.01 mm).

Composition of Dispersion

Polymeric material 100 parts by weight (polyamide, the trade name "Amilan CM8000", Toray Industries, Inc.)

Conductor 14 parts by weight (carbon black, the trade name "Monarch 1000", Cabot Corporation)

Solvent 500 parts by weight (methanol, Kanto Chemical Co., Inc.)

Solvent 240 parts by weight (butanol, Kanto Chemical Co., Inc.)

Example 2

A charging member 2 including an adhesive layer, an elastic layer, and a surface layer is fabricated as in Example 1 except that the vulcanization accelerator for the rubber composition prepared in Example 1 (Nocceler EZ, zinc diethyldithiocarbamate, Ouchi Shinko Chemical Industrial Co., Ltd.) is used in an amount of 1.0 part by weight (number of moles of metal element: 0.003 mol).

Example 3

A charging member 3 including an adhesive layer, an elastic layer, and a surface layer is fabricated as in Example 1 except that the vulcanization accelerator for the rubber composition prepared in Example 1 (Nocceler EZ, zinc diethyldithiocarbamate, Ouchi Shinko Chemical Industrial Co., Ltd.) is used in an amount of 14 parts by weight (number of moles of metal element: 0.039 mol).

Example 4

A charging member 4 including an adhesive layer, an elastic layer, and a surface layer is fabricated as in Example 1 except that the vulcanization accelerator for the rubber composition prepared in Example 1 is replaced by 7 parts by weight (number of moles of metal element: 0.019 mol) of another vulcanization accelerator (Nocceler BZ, zinc dibutyldithiocarbamate, Ouchi Shinko Chemical Industrial Co., Ltd.).

Example 5

A charging member 5 including an adhesive layer, an elastic layer, and a surface layer is fabricated as in Example 1 except that the vulcanization accelerator for the rubber composition prepared in Example 1 is replaced by 4 parts by weight (number of moles of metal element: 0.011 mol) of another vulcanization accelerator (Nocceler PZ, zinc dimethyldithiocarbamate, Ouchi Shinko Chemical Industrial Co., Ltd.).

Example 6

A charging member 6 including an adhesive layer, an elastic layer, and a surface layer is fabricated as in Example 1 except that the vulcanization accelerator for the rubber composition prepared in Example 1 is replaced by 5.2 parts by weight (number of moles of metal element: 0.014 mol) of another vulcanization accelerator (Nocceler PX, zinc N-ethyl-N-phenyldithiocarbamate, Ouchi Shinko Chemical Industrial Co., Ltd.).

Example 7

A charging member 7 including an adhesive layer, an elastic layer, and a surface layer is fabricated as in Example 1 except that the vulcanization accelerator for the rubber composition prepared in Example 1 is replaced by 3.2parts by weight (number of moles of metal element: 0.014 mol) of another vulcanization accelerator (Nocceler ZP, zinc N-pentamethylenedithiocarbamate, Ouchi Shinko Chemical Industrial Co., Ltd.).

Example 8

A charging member 8 including an adhesive layer, an elastic layer, and a surface layer is fabricated as in Example 1 except that the vulcanization accelerator for the rubber composition prepared in Example 1 is replaced by 4.2 parts by weight (number of moles of metal element: 0.014 mol) of another vulcanization accelerator (Nocceler TP, sodium dibutyldithiocarbamate, Ouchi Shinko Chemical Industrial Co., Ltd.).

Example 9

A charging member 9 including an adhesive layer, an elastic layer, and a surface layer is fabricated as in Example 1 except that the vulcanization accelerator for the rubber composition prepared in Example 1 is replaced by 4.0 parts by weight (number of moles of metal element: 0.014 mol) of another vulcanization accelerator (Nocceler TTTE, tellurium diethyldithiocarbamate, Ouchi Shinko Chemical Industrial Co., Ltd.).

Example 10

A charging member 10 including an adhesive layer, an elastic layer, and a surface layer is fabricated as in Example 1 except that the vulcanizing agent for the rubber composition prepared in Example 1 ("Vulnoc R", 4,4'-dithiodimorpholine, Ouchi Shinko Chemical Industrial Co., Ltd.) is used in an amount of 0.5 part by weight.

Example 11

A charging member 11 including an adhesive layer, an elastic layer, and a surface layer is fabricated as in Example 1 except that the vulcanizing agent for the rubber composition prepared in Example 1 ("Vulnoc R", 4,4'-dithiodimorpholine, Ouchi Shinko Chemical Industrial Co., Ltd.) is used in an amount of 15 parts by weight.

Example 12

A charging member 12 including an adhesive layer, an elastic layer, and a surface layer is fabricated as in Example 1 except that the vulcanizing agent for the rubber composition prepared in Example 1 ("Vulnoc R", 4,4'-dithiodimorpholine, Ouchi Shinko Chemical Industrial Co., Ltd.) is used in an amount of 5 parts by weight.

Example 13

A charging member 13 including an adhesive layer, an elastic layer, and a surface layer is fabricated as in Example 1 except that the vulcanizing agent for the rubber composition prepared in Example 1 ("Vulnoc R", 4,4'-dithiodimorpholine, Ouchi Shinko Chemical Industrial Co., Ltd.) is used in an amount of 10 parts by weight.

Comparative Example 1

A charging member C1 including an adhesive layer, an elastic layer, and a surface layer is fabricated as in Example 1 except that the vulcanizing agent for the rubber composition prepared in Example 1 is replaced by sulfur (the trade name "Golden Flower Sulfur Powder 200 Mesh", Tsurumi Chemical Industry Co., Ltd.).

Comparative Example 2

A charging member C2 including an adhesive layer, an elastic layer, and a surface layer is fabricated as in Example 1 except that another vulcanizing agent (sulfur, the trade name "Golden Flower Sulfur Powder 200 Mesh", Tsurumi Chemical Industry Co., Ltd.) is added to the rubber composition prepared in Example 1 in an amount of 1.0 part by weight.

Comparative Example 3

A charging member C3 including an adhesive layer, an elastic layer, and a surface layer is fabricated as in Example 1 except that another vulcanization accelerator (Nocceler PX, zinc N-ethyl-N-phenyldithiocarbamate, Ouchi Shinko Chemical Industrial Co., Ltd.) is added to the rubber composition prepared in Example 1 in an amount of 2.0 parts by weight (number of moles of metal element: 0.005 mol).

Comparative Example 4

A charging member C4 including an adhesive layer, an elastic layer, and a surface layer is fabricated as in Example 1 except that another vulcanization accelerator (Nocceler M-P, 2-mercaptobenzothiazole, Ouchi Shinko Chemical Industrial Co., Ltd.) is added to the rubber composition prepared in Example 1 in an amount of 3.0 parts by weight (number of moles of metal element: 0 mol).

Comparative Example 5

A charging member C5 including an adhesive layer, an elastic layer, and a surface layer is fabricated as in Example 1 except that the vulcanization accelerator for the rubber composition prepared in Example 1 (Nocceler EZ, zinc diethyldithiocarbamate, Ouchi Shinko Chemical Industrial Co., Ltd.) is used in an amount of 0.8 part by weight (number of moles of metal element: 0.002 mol) .

Comparative Example 6

A charging member C6 including an adhesive layer, an elastic layer, and a surface layer is fabricated as in Example 1 except that the vulcanization accelerator for the rubber composition prepared in Example 1 (Nocceler EZ, zinc diethyldithiocarbamate, Ouchi Shinko Chemical Industrial Co., Ltd.) is used in an amount of 18.0 parts by weight (number of moles of metal element: 0.05 mol).

Comparative Example 7

A charging member C7 including an adhesive layer, an elastic layer, and a surface layer is fabricated as in Example 1 except that the vulcanizing agent for the rubber composition prepared in Example 1 ("Vulnoc R", 4,4'-dithiodimorpholine, Ouchi Shinko Chemical Industrial Co., Ltd.) is used in an amount of 0.1 part by weight.

Comparative Example 8

A charging member C8 including an adhesive layer, an elastic layer, and a surface layer is fabricated as in Example 1 except that the vulcanizing agent for the rubber composition prepared in Example 1 ("Vulnoc R", 4,4'-dithiodimorphloine, Ouchi Shinko Chemical Industrial Co., Ltd.) is used in an amount of 20 parts by weight.

Table 1 shows the vulcanizing agents and vulcanization accelerators used for the elastic layers of the charging members fabricated in the Examples and Comparative Examples.

In Table 1, the contents of the vulcanizing agents and the vulcanization accelerators are based on 100 parts by weight of the epichlorohydrin-ethylene oxide-allyl glycidyl ether copolymer rubber, and the metal contents (mol) of the vulcanization accelerators are based on 100 g of the epichlorohydrin-ethylene oxide-allyl glycidyl ether copolymer rubber.

electric heat press using a die for forming a test piece in accordance with JIS K 6262 (1997) at 170° C. for 20 minutes to form a test piece. The test piece is set on a compression jig. The test piece is inserted in the center between compression plates, with specified spacers inserted outside the test piece. The test piece is compressed 25% in a hot-air dryer at 70° C. for 22 hours. After the test piece is left standing for 30 minutes, the recovery thereof is measured. The compression set of the elastic layer is determined by the following equation:

$$CS = \frac{t_0 - t_2}{t_0 - t_1} \times 100$$

CS: compression set (%)

$t_0$: original thickness of test piece (mm)

$t_1$: thickness of spacers (mm)

$t_2$: thickness of test piece 30 minutes after removal from compression apparatus Image Evaluation Each of the charging members fabricated as described above in the Examples and Comparative Examples is mounted as a charging roller on a DocuCentre Color 400CP color copier (from Fuji Xerox Co., Ltd.) having the structure shown in FIG. 5 and is left standing for 24 hours.

An initial printing test is performed on A4 paper using color toners (cyan, magenta, yellow, and black toners) for the DocuCentre Color 400CP color copier (after printing ten copies at 10° C. and 15% RH and after printing ten copies at 28° C. and 85% RH).

| | Vulcanizing agent | | Vulcanization accelerator | | |
|---|---|---|---|---|---|
| | Compound name | Content (parts by weight) | Compound name | Content (parts by weight) | Metal content (mol) |
| Example 1 | 4,4'-Dithiodimorpholine | 1 | Zinc diethyldithiocarbamate | 5 | 0.014 |
| Example 2 | 4,4'-Dithiodimorpholine | 1 | Zinc diethyldithiocarbamate | 1 | 0.003 |
| Example 3 | 4,4'-Dithiodimorpholine | 1 | Zinc diethyldithiocarbamate | 14 | 0.039 |
| Example 4 | 4,4'-Dithiodimorpholine | 1 | Zinc dibutyldithiocarbamate | 7 | 0.019 |
| Example 5 | 4,4'-Dithiodimorpholine | 1 | Zinc dimethyldithiocarbamate | 4 | 0.011 |
| Example 6 | 4,4'-Dithiodimorpholine | 1 | Zinc N-ethyl-N-phenyldithiocarbamate | 5.2 | 0.014 |
| Example 7 | 4,4'-Dithiodimorpholine | 1 | Zinc N-pentamethylenedithiocarbamate | 3.2 | 0.014 |
| Example 8 | 4,4'-Dithiodimorpholine | 1 | Sodium dibutyldithiocarbamate | 4.2 | 0.014 |
| Example 9 | 4,4'-Dithiodimorpholine | 1 | Tellurium diethyldithiocarbamate | 4 | 0.014 |
| Example 10 | 4,4'-Dithiodimorpholine | 0.5 | Zinc diethyldithiocarbamate | 5 | 0.014 |
| Example 11 | 4,4'-Dithiodimorpholine | 15 | Zinc diethyldithiocarbamate | 5 | 0.014 |
| Example 12 | 4,4'-Dithiodimorpholine | 5 | Zinc diethyldithiocarbamate | 5 | 0.014 |
| Example 13 | 4,4'-Dithiodimorpholine | 10 | Zinc diethyldithiocarbamate | 5 | 0.014 |
| Comparative Example 1 | Sulfur | 1 | Zinc diethyldithiocarbamate | 5 | 0.014 |
| Comparative Example 2 | 4,4'-Dithiodimorpholine<br>Sulfur | 1<br>1 | Zinc dielhyldithiocarbamate | 5 | 0.014 |
| Comparative Example 3 | 4,4'-Dithiodimorpholine | 1 | Zinc diethyldithiocarbamate<br>Zinc N-ethyl-N-phenyldithiocarbamate | 5<br>2 | 0.014<br>0.005 |
| Comparative Example 4 | 4,4'-Dithiodimorpholine | 1 | Zinc diethyldithiocarbamate<br>2-Mercaptobenzothiazole | 5<br>3 | 0.014<br>0 |
| Comparative Example 5 | 4,4'-Dithiodimorpholine | 1 | Zinc diethyldithiocarbamate | 0.8 | 0.002 |
| Comparative Example 6 | 4,4'-Dithiodimorpholine | 1 | Zinc diethyldithiocarbamate | 18 | 0.05 |
| Comparative Example 7 | 4,4'-Dithiodimorpholine | 0.1 | Zinc diethyldithiocarbamate | 5 | 0.014 |
| Comparative Example 8 | 4,4'-Dithiodimorpholine | 20 | Zinc diethyldithiocarbamate | 5 | 0.014 |

Evaluations

Compression Set Measurement

A portion of the elastic layer of the charging member formed in each of the Examples and Comparative Examples is removed from an end of the shaft and is vulcanized in an The initial images are visually inspected for variations in the density of the halftone images. The image quality is rated on the following scale:

A: No density variations or point defects

B: Negligible density variations or point defects

C: Slight density variations or point defects

D: Practically unacceptable density variations or point defects

Table 2 shows the evaluation results.

| | Compression set (%) | Image evaluation |
|---|---|---|
| Example 1 | 10 | A |
| Example 2 | 15 | A |
| Example 3 | 8 | A |
| Example 4 | 19 | B |
| Example 5 | 18 | B |
| Example 6 | 17 | B |
| Example 7 | 18 | B |
| Example 8 | 17 | B |
| Example 9 | 18 | B |
| Example 10 | 19 | B |
| Example 11 | 18 | B |
| Example 12 | 14 | A |
| Examale 13 | 15 | A |
| Comparative Example 1 | 40 | D |
| Comparative Example 2 | 27 | D |
| Comparative Example 3 | 23 | C |
| Comparative Example 4 | 27 | D |
| Comparative Example 5 | 30 | C |
| Comparative Example 6 | — | — |
| Comparative Example 7 | 45 | D |
| Comparative Example 8 | 30 | D |

In Comparative Example 6, the rubber composition could not be extruded because of increased rubber viscosity during extrusion.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging member comprising:

a conductive support; and a conductive elastic layer on the conductive support, the conductive elastic layer comprising a crosslinked product of a rubber composition comprising a ternary epichlorohydrin rubber being a copolymer of epichlorohydrin, an alkylene oxide, and allyl glycidyl ether, 4,4'-dithiodimorpholine, and a vulcanization accelerator being a metal salt in an amount corresponding to 0.003 to 0.04 mol of metal per 100 g of the ternary epichlorohydrin rubber, the conductive elastic layer having a compression set of 20% or less.

2. The charging member according to claim 1, wherein the vulcanization accelerator is present in an amount corresponding to 0.006 to 0.02 mol of metal per 100 g of the ternary epichlorohydrin rubber.

3. The charging member according to claim 1, wherein the vulcanization accelerator is a metal salt of diethyldithiocarbamic acid.

4. The charging member according to claim 1, wherein the vulcanization accelerator is zinc diethyldithiocarbamate.

5. The charging member according to claim 1, wherein the 4,4'-dithiodimorpholine is present in an amount of 0.5 to 15 parts by weight per 100 parts by weight of the ternary epichlorohydrin rubber.

6. The charging member according to claim 1, wherein the 4,4'-dithiodimorpholine is present in an amount of 1.0 to 10 parts by weight per 100 parts by weight of the ternary epichlorohydrin rubber.

7. An image-forming apparatus comprising:

an electrophotographic photoreceptor;

a charging unit comprising the charging member according to claim 1, the charging member being disposed in contact with a surface of the electrophotographic photoreceptor to charge the electrophotographic photoreceptor;

an electrostatic-latent-image forming unit that forms an electrostatic latent image on the surface of the charged electrophotographic photoreceptor;

a developing unit that develops the electrostatic latent image formed on the surface of the electrophotographic photoreceptor with a developer comprising a toner to form a toner image; and a transfer unit that transfers the toner image to a surface of a recording medium.

8. A process cartridge comprising a charging unit comprising the charging member according to claim 1, the charging member being disposed in contact with a surface of an electrophotographic photoreceptor to charge the electrophotographic photoreceptor.

* * * * *